US005303833A

United States Patent [19]

Hayashi et al.

[11] Patent Number: 5,303,833

[45] Date of Patent: Apr. 19, 1994

[54] BLOW-MOLDED BOTTLE-SHAPED CONTAINER MADE OF SYNTHETIC RESIN

[75] Inventors: Yoshiaki Hayashi, Matsudo; Akiho Ota, Funabashi; Hiroaki Sugiura, Itabashi, all of Japan

[73] Assignee: Yoshino Kogyosho Co., Ltd., Tokyo, Japan

[21] Appl. No.: 3,952

[22] Filed: Jan. 19, 1993

Related U.S. Application Data

[63] Continuation of Ser. No. 853,345, Mar. 16, 1992, abandoned, which is a continuation of Ser. No. 622,276, Dec. 6, 1990, abandoned, which is a continuation of Ser. No. 422,665, Oct. 17, 1989, abandoned.

[30] Foreign Application Priority Data

Apr. 20, 1988 [JP] Japan ..... 63-53138
May 24, 1988 [JP] Japan ..... 63-68530

[51] Int. Cl.[5] ..... B65D 23/00
[52] U.S. Cl. ..... 215/1 C; 220/675
[58] Field of Search ..... 215/1 C; D9/349-351, D9/355, 367, 378, 390-392, 394-400, 403-413; 220/675

[56] References Cited

U.S. PATENT DOCUMENTS

| | | | |
|---|---|---|---|
| D. 121,426 | 7/1940 | Steelman | D9/397 |
| D. 205,250 | 7/1966 | Ballard et al. | D9/397 |
| D. 214,425 | 6/1969 | Vanderhyde | D9/397 |
| D. 258,565 | 3/1981 | Sekiguchi | D9/397 X |
| D. 303,497 | 9/1984 | Larson | D9/396 X |
| 3,029,963 | 4/1962 | Evers | 215/1 C |
| 3,708,082 | 1/1973 | Platte | 215/1 C |
| 4,386,701 | 6/1983 | Galer | 215/1 C X |
| 4,805,788 | 2/1989 | Akiho . | |
| 4,818,575 | 4/1989 | Hirata et al. | 215/1 C X |

FOREIGN PATENT DOCUMENTS

| | | | |
|---|---|---|---|
| 1157785 | 11/1983 | Canada . | |
| 3215866A1 | 11/1983 | Fed. Rep. of Germany . | |
| 1408869 | 7/1965 | France | 215/1 C |
| 2430891 | 2/1980 | France . | |
| 62-52032 | 3/1987 | Japan . | |
| 62-52033 | 3/1987 | Japan . | |
| 62-52034 | 3/1987 | Japan . | |
| 62-52035 | 3/1987 | Japan . | |
| 386268 | 4/1965 | Switzerland . | |
| 1074162 | 6/1967 | United Kingdom | 215/1 C |
| 2025889 | 1/1980 | United Kingdom | 215/1 C |

OTHER PUBLICATIONS

Closeup of Vanderhyde, showing inclined relationship of adjacent containers.

*Primary Examiner*—Bryon P. Gehman
*Attorney, Agent, or Firm*—Oliff & Berridge

[57] ABSTRACT

A biaxially blow-molded bottle-shaped container having a body and a lower end of the body between the body and a leg of the body, wherein a diameter of said lower end of the body is the largest diameter of the container; a circumferential rib is provided and externally swelled on the lower end of the body; and upper and lower portions of the circumferential rib comprise a rib wall in the form of a tapered wall. A container including an upper end of the body having the largest diameter of the container may be used. In this case, the diameter of the upper end of the body is equal to that of the lower end of the body; the circumferential rib is provided and externally swelled on the upper end of the body; and upper and lower portions of the circumferential rib comprise rib walls in the form of a tapered wall.

5 Claims, 4 Drawing Sheets

BLOW-MOLDED BOTTLE-SHAPED CONTAINER MADE OF SYNTHETIC RESIN

This is a continuation of application Ser. No. 07/853,345 filed Mar. 16, 1992, now abandoned, which in turn is a continuation of application Ser. No. 07/622,276, filed Dec. 6, 1990, now abandoned, which in turn is a continuation of application Ser. No. 07/422,665, filed Oct. 17, 1989, now abandoned.

FIELD OF THE INVENTION

The present invention relates to a biaxially blow-molded bottle-shaped container made of synthetic resin, and more particularly, to a construction of portions which contact with each other when said bottle-shaped containers are stood upright to be adjacent to each other.

PRIOR ART

Biaxially blow-molded bottle-shaped containers made of synthetic resin (hereinafter referred to as "blow-molded bottle-shaped containers") such as polyethylene terephthalate resin are typically each filled with contents, sealed by a cap, applied with a label and packed in a corrugated card-board box by a packer, while being transported.

Most of such blow-molded bottle-shaped containers are relatively large. Accordingly, their weight when filled is considerably heavy.

It is desired that a quantity of synthetic resin material required to mold a bottle-shaped container be as small as possible to form a bottle-shaped container at lower cost. Accordingly, the blow-molded bottle-shaped container is molded by sufficiently orienting a parison. Accordingly, a wall thickness of a body of the bottle-shaped container which forms a main portion of a content receiving portion is very thin.

In a blow-molded bottle-shaped container molded by sufficiently orienting a parison, there cannot always be obtained an uprightness with high accuracy (when a bottle-shaped container is stood upright on a horizontal surface, a larger angle of inclination with respect to a vertical line of a center axis of the container results in poor uprightness of the container) due to an internal strain or the like caused by orientation, and the bottle-shaped container is stood upright in a slightly inclined attitude. Particularly, in the case of a blow-molded bottle-shaped container molded as a heat-resistant bottle-shaped container, the inferiority of the uprightness tends to increase.

Since the blow-molded bottle-shaped container is heavy when it is filled with a content liquid, if the container is slidably moved even on a smooth plane, a considerable sliding resistance occurs. Since the wall thickness of the body which forms a main portion of a bottle-shaped container is thin, when a strong lateral load is applied to the body, it becomes easily depressed and deformed. Since the uprightness of the bottle-shaped container is not good, when a number of blow-molded bottle-shaped containers are arranged to be adjacent to each other in an upright attitude, portions of the body contacted with the adjacent blow-molded bottle-shaped containers are not constant.

Where the bottle-shaped containers are slidably conveyed, the sliding resistance produced between the conveying surface and the blow-molded bottle-shaped container is high. When a number of blow-molded bottle-shaped containers arranged to be adjacent to each other along a constant conveying line are pressed from the back and slidably conveyed on the conveying surface, a great lateral load acts on the body contacted with the adjacent blow-molded bottle-shaped container. The central portion of the body is not always sufficient in mechanical strength with respect to the lateral load. When the high lateral load acts on the central portion of the body, there gives rise to an occurrence of depressed deformation in the central portion of the body. Furthermore, since the uprightness of the blow-molded bottle-shaped containers is not good, when a plurality of containers placed to be adjacent to each other are pressed and slidably conveyed, the uprightness of each of the blow-molded bottle-shaped containers becomes unstable. Accordingly, an accurate detection of the position of a bottle-shaped container becomes impossible. In some cases, bottle-shaped containers being conveyed fall so that operation should be discontinued.

In a conventional blow-molded bottle-shaped container of this kind, in order to overcome the aforementioned inconveniences, a diameter of a lower portion contacted with a leg is made sufficiently larger than other portions of the body so that when the blow-molded bottle-shaped containers are arranged to be adjacent to each other, the lower end portions of the bodies contact with each other. Since the lower end of the body having a large diameter is close to the leg, the lower end of the body is of relatively high mechanical strength. The lower end of the body receives a lateral load exerted when a plurality of bottle-shaped containers are slidably conveyed. Since the lower end of the body is positioned at the lower end of the blow-molded bottle-shaped container, a moment acting on a blow-molded bottle-shaped container is reduced due to the sliding resistance and the pressing conveying force when the plurality of bottle-shaped containers are slidably conveyed.

As described above, in prior art, the lower end of the body is made to have a large diameter, and the blow-molded bottle-shaped containers stood upright and arranged to be adjacent to each other are made to contact with each other at their lower ends of the bodies, whereby a number of blow-molded bottle-shaped containers can be slidably conveyed in an upright and stabilized attitude. However, recently, many blow-molded bottle-shaped containers have been subjected to processing such as filling with liquids per unit time. Therefore, the lateral load acting on the lower end of the body when the containers upright and adjacent to each other are pressed and slidably conveyed becomes more powerful. Accordingly, the mechanical durability of the lower end of the body with respect to the lateral load was required to be increased.

The simplest countermeasure to the aforesaid demand is to sufficiently increase a wall thickness of the lower end of the body. However, when the wall thickness of the lower portion of the body is increased, the quantity of an expensive synthetic resin material required to mold a blow-molded bottle-shaped container increases by said increased portion, resulting in an increase in price of the blow-molded bottle-shaped container. Therefore, this countermeasure is not desirable.

The countermeasure considered to be most effective for fulfilling the aforesaid demand is to control a wall thickness of the container when a blow-molded bottle-shaped container is biaxial blow-molded so that the wall thickness of the lower end of the body is made larger than the wall thickness of other body portions. This conventional means is intended to increase the wall thickness of the lower end of the body to thereby increase the mechanical strength of the lower portion of the body. The conventional means can obtain an effect of increasing the mechanical strength of the lower portion of the body. However, the wall thickness of the other portions of the body is to be reduced by a portion having increased wall thickness of the lower portion of the body. Because of this, there gives rise to an important problem of considerably lowering fundamental functions of the blow-molded bottle-like container as a container, such as durability of the body with respect to the lateral load, durability of other body portions with respect to the lateral load, shape stability of the body with respect to a gripping force during handling, constantness and stability of pressure reduction absorbing deformation in a heat resistant bottle-shaped container, and the like.

SUMMARY OF THE INVENTION

The present invention has been accomplished in order to overcome the above-mentioned problems encountered in the prior art. A principal object of the present invention is to considerably increase the mechanical strength with respect to a lateral load at a lower portion of a body of a container without reducing a wall thickness of other portions of the body and without increasing the amount of synthetic resin material required to mold a bottle-shaped container.

The present invention provides a biaxially blow-molded bottle-shaped container (1) having a body (2) and a lower end (4) of the body between the body (2) and a leg (7) of the body (2), wherein a diameter of said lower end (4) of the body is the largest diameter of the container; a circumferential rib (5) is provided and externally swelled on the lower end (4) of the body; and upper and lower portions of the circumferential rib (5) comprise a rib wall (5*a*) in a form of a tapered wall.

A "main portion of a body" refers to a portion which has a function to receive and hold a content liquid. For example, in the case of a heat-resistant bottle-shaped container, the "main portion of the body" is a body portion formed with an absorbing panel wall for absorbing reduced-pressure in the container. In a general concept, the "main portion of the body" is a portion having a substantially uniform diameter, other than a shoulder and a bottom including the leg.

The present invention, is not limited to providing a single circumferential rib. A circumferential recessed groove having a small groove width (a sufficiently smaller groove width than a longitudinal width of a circumferential rib) may be interposed between circumferential ribs so that two or more circumferential ribs are disposed in parallel.

The circumferential rib is inflated from the lower end of the body. Accordingly, the circumferential ribs of adjacent containers contact with each other so that the blow-molded bottle-shaped containers are stood upright adjacent to each other. A pressing force for press-conveyance acting on an upstream blow-molded bottle-shaped container to an adjacent blow-molded bottle-shaped container during slidable conveyance of blow-molded bottle-shaped containers directly acts on the circumferential rib.

Since the circumferential rib adapted to directly receive the pressing force from the adjacent blow-molded bottle-shaped container is designed to have upper and lower rib walls in the form of a tapered wall, rib walls act as a reinforcing rib. Accordingly, the pressing force exerted from the adjacent blow-molded bottle-shaped container is received by the sufficient mechanical strength to considerably increase the mechanical durability with respect to the lateral load of the whole lower end of the body.

In the case where two or more circumferential ribs are disposed in parallel, the number of rib walls serving as the reinforcing rib increases, and the mechanical durability with respect to the lateral load at the lower end of the body can be increased.

The reason why the width of the circumferential recessed groove positioned between the circumferential ribs where the plurality of circumferential ribs are disposed in parallel is to prevent a circumferential rib of a blow-molded bottle-shaped container from being moved onto a circumferential rib of the adjacent blow molded bottle shaped container to greatly incline the other blow-molded bottle-shaped container during conveyance.

DESCRIPTION OF THE PREFERRED EMBODIMENTS

Figure 1:
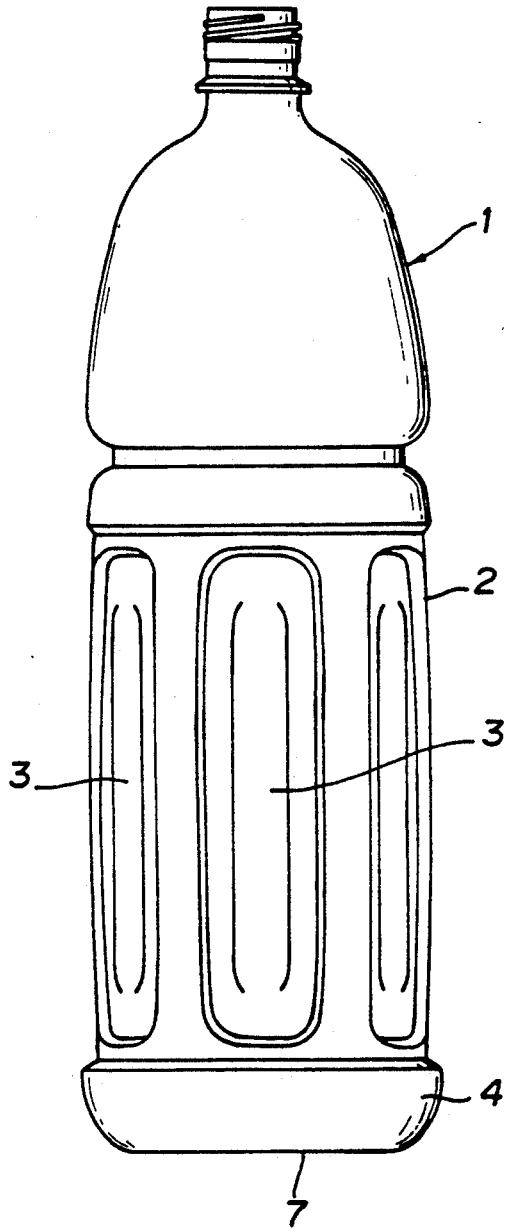
FIG. 1 is a front view of a polyethylene terephthalate bottle-shaped container applied to work out first and second embodiments of the present invention.

FIG. 1 shows one example of a bottle-shaped container suitable for being provided with a circumferential rib in first and second embodiments according to the present invention. A reference numeral 1 designates a biaxially blow-molded polyethylene terephthalate bottle-shaped container. The container 1 has a volume of approximately 1 to 1.5 liters. The container 1 includes a body 2 and a leg 7. Longitudinally extending absorbing panel walls 3 are circumferentially provided in parallel in a tubular wall portion from a center to a lower portion of the body 2. Reduced pressure is produced within the container 1 when said container 1 is cooled after the container is filled with a content liquid, sealed and heated to a high temperature at approximately 85° C. The reduced pressure is absorbed by depression and deformation of the absorbing panel wall 3. A diameter of a lower end 4 of the body is largest in the container. The wall thickness of the body 2 including the lower end 4 is uniformly 0.4 mm without applying wall-thickness adjusting means thereto.

Figure 2:
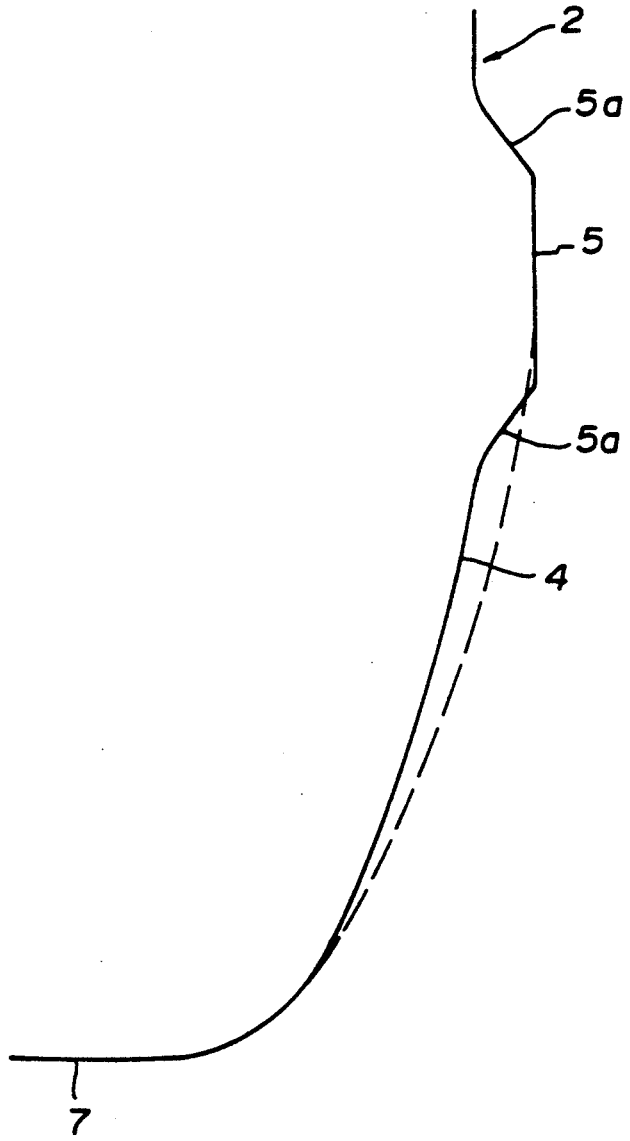
FIG. 2 is a view showing a contour line of essential parts of the first embodiment of the present invention in an enlarged longitudinal section.

FIG. 2 shows a contour line in a partly enlarged longitudinal section of a first embodiment of the invention in which a single circumferential rib 5 is circumferentially provided in the lower end 4 of the body. The circumferential rib 5 has rib walls 5*a* on both upper and lower end walls in the form of a tapered tubular wall.

In FIG. 2, the broken line indicates a contour line of prior art. The circumferential rib 5 of the present invention is not formed as a part of a curved surface smoothly continuous to the outer circumferential surface of the lower end 4 of the body as in prior art. In the circumferential rib 5 of the present invention, the largest diameter portion is the circumferential rib 5, and the diameter of portions of the lower end 4 other than the circumferential rib 5 is reduced. The circumferential rib 5 in the first embodiment of the present invention has a relatively large height. The reason why the circumferential rib 5 is formed by leaving the largest diameter portion of the lower end 4 of the body in prior art is to prevent the diameter of the lower portion 4 of the body from being increased more than as needed by the provision of the circumferential rib 5. The reason why the height of the circumferential rib 5 is relatively large is because pressed adjacent containers 1 are always placed in contact with each other at the circumferential ribs 5 even if the upright attitude is slightly inclined.

In the first embodiment shown in FIG. 2, when a lateral load of 5 Kg was applied to the container, a distortion of the lower end 4 of the body in a radial direction was 1.20 mm. On the other hand, when a lateral load of 5 Kg was applied to a container not provided with the circumferential rib 5 at the lower end 4 of the body, a distortion of the lower end 4 of the body in a radial direction was 1.50 mm. According to the first embodiment of the present invention, the distortion of the lower end 4 of the body in a radial direction can be considerably reduced and an occurrence of buckling deformation can be completely eliminated.

Figure 3:
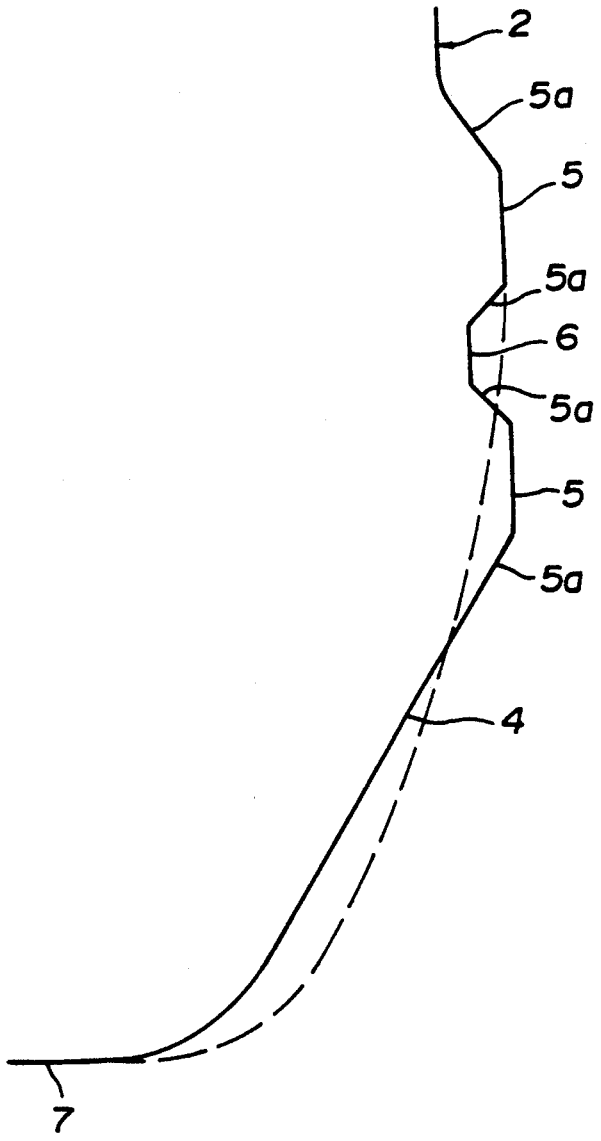
FIG. 3 is a view showing a contour line of essential parts of the second embodiment of the present invention in an enlarged longitudinal section.

FIG. 3 shows a second embodiment in which two circumferential ribs 5 are provided in parallel. A height of each circumferential rib 5 is smaller than that of the circumferential rib 5 shown in FIG. 2. However, the sum of the height of both the circumferential ribs 5 is larger than the height of the circumferential rib in the first embodiment shown in FIG. 2.

The test for lateral load was conducted with respect to the container in the second embodiment shown in FIG. 3 under the same conditions as noted above. The distortion of the lower end 4 of the body in a radial direction was 1.09 to 1.12 mm, and the distortion can be further considerably reduced, and the occurrence of the buckling deformation can be completely eliminated.

The wall thickness of the lower end 4 controlled by the wall thickness controlling means was 0.55 mm which is larger by 0.15 mm than that of the container 1 according to the present invention. When the aforementioned lateral load test was conducted with respect to this container, the distortion of the lower end of the body in a radial direction was 1.13 mm, and thus the container exhibits an excellent durability. However, as previously mentioned, since the wall thickness of the body 2 other than the lower end 4 is small, the function of the container as a whole was deteriorated.

Next, the third embodiment of the present invention will be described. In the third embodiment, largest diameter portions of a biaxially blow-molded bottle-shaped container made of synthetic resin include an upper end of a body which is an upper end of the main portion of the body and a lower end of a body connecting with a leg of the body. The diameter of the upper end of the body is equal to that of the lower end of the body. Both the upper and lower ends of the body are circumferentially provided with circumferential ribs, respectively.

As described above, two circumferential ribs are provided on the upper and lower portions of the body. Accordingly, the pressing force for conveyance acting on a container from the adjacent container is divided into upper and lower portions. Because of this, a lateral load acting on a single circumferential rib is reduced by half, and therefore, the mechanical durability with respect to high lateral load of the container as a whole is exhibited.

Circumferential ribs having the largest diameter are positioned at both the upper and lower ends of the main portion of the body. Accordingly, when containers are pressed and placed to be adjacent to each other, the containers are pressed and contacted with each other at both upper and lower circumferential ribs. Portions of the body other than the circumferential rib which are weak with respect to the lateral load are positively prevented from being directly pressed so that said portions are depressed and deformed. The adjacent containers are pressed and contacted with each other at both the upper and lower circumferential ribs. Accordingly, even if there is a container which is poor in uprightness, the container is supported at four points by adjacent containers, and therefore, the upright attitude of each container during pressing and slidable conveyance can be held at a stabilized constant state.

Figure 4:
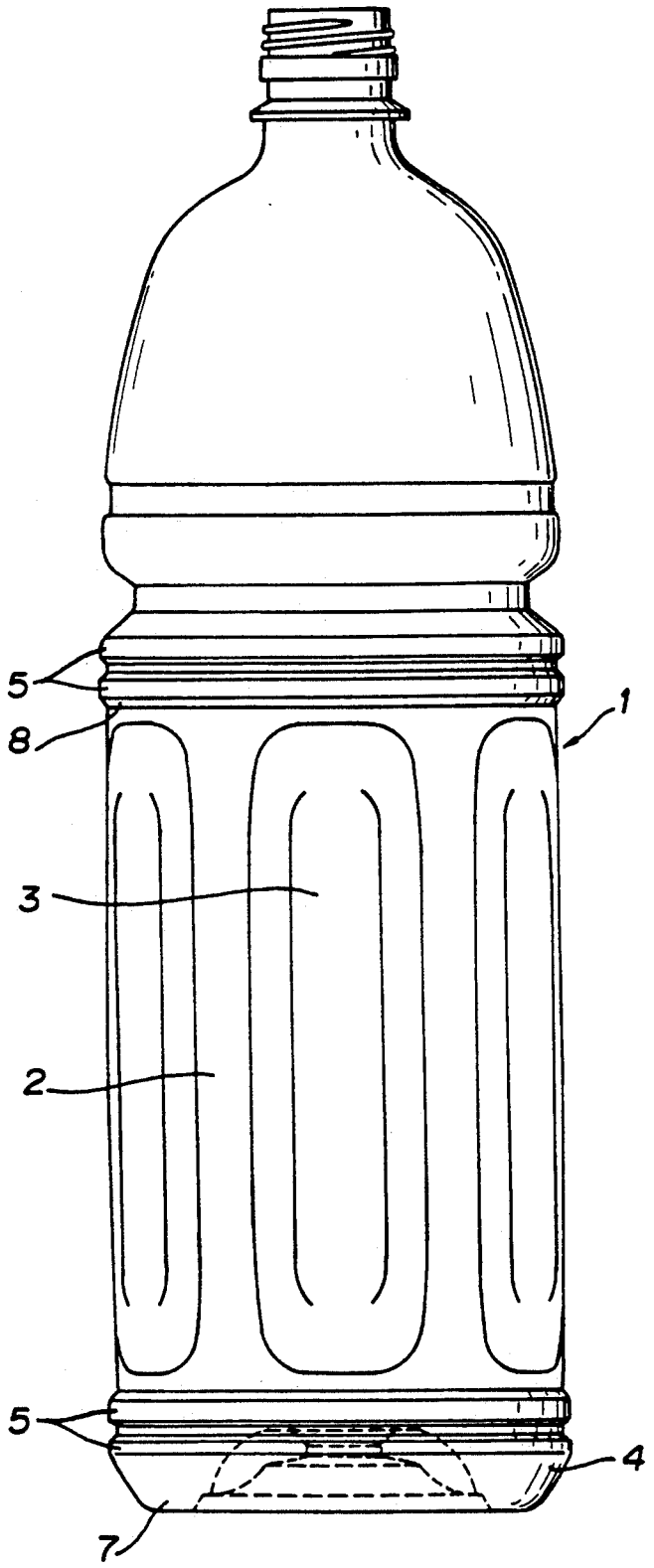
FIG. 4 is a front view of a polyethylene terephthalate bottle-shaped container applied to work out third and fourth embodiments of the present invention.

FIG. 4 shows an example of a bottle-shaped container suitable for being applied with a circumferential rib according to a third embodiment of the present invention. A diameter of an upper end 8 of the body which is an upper end of a main portion of a body 2 is largest in the container, and is equal to a diameter of the lower end 4 of the body which is the lower end of the main portion of the body 2. Constructions other than the upper end 8 are same as those of the container shown in FIG. 1.

A single circumferential rib 5 is circumferentially provided in an externally swelled configuration as shown in FIG. 2 on the lower end 4 of the body of the container shown in FIG. 4. According to the actual measurement, the distortion of the upper end 8 and the lower end 4 in a radial direction when 5 Kg of lateral load is applied to the container of the third embodiment was 0.60 mm on the average The distortion of the upper end and the lower end when 5 Kg of lateral load is applied to a container not provided with the circumferential rib 5 was 1.50 mm. Accordingly, according to the third embodiment of the present invention, the distortion of the lower end 4 of the body in a radial direction can be further considerably reduced, and the buckling deformation can be completely eliminated.

Next, a fourth embodiment of the present invention will be described. Two circumferential ribs 5 are provided in parallel as shown in FIG. 3 on the lower end 4 of the body of the container shown in FIG. 4. Two circumferential ribs 5 are provided in parallel on the upper end 8 of the body of the container shown in FIG. 4. The height of each circumferential rib 5 is smaller than that of the circumferential rib 5 shown in FIG. 2. However, the sum of the height of both the circumferential ribs 5 are larger than that of the circumferential rib 5 in the third mode of embodiment.

The lateral load test was conducted under the same conditions as noted above with respect to the container according to the fourth embodiment. The distortion of the lower end 4 of the body in a radial direction was 0.54 to 0.56 mm. The distortion can be further considerably reduced and the occurrence of buckling deformation was completely eliminated.

The containers according to the present invention have the construction as described above, and provide the following effects.

The circumferential rib acts as a reinforcing rib. Accordingly, the mechanical durability of the lower end of the body (and the upper end of the body) with respect to the lateral load can be considerably increased. Accordingly, the occurrence of buckling deformation of the lower end of the body (and the upper end of the body) when the container is pressed and slidably conveyed can be prevented.

The circumferential rib is formed and externally swelled by bending a wall having a substantially same wall thickness as the lower end of the body (and the upper end of the body). Accordingly, it is not necessary to increase the wall thickness of the lower end of the body (and the upper end of the body) partially to be projected. Accordingly, there occurs no inconvenience that the wall thickness of the other portions of the body of the container is reduced so as to lower the fundamental function of the container as a container. Since it is not necessary that synthetic resin material be further added to partially increase the wall thickness of the lower end of the body (and the upper end of the body), the unit price of containers is not increased due to an increase in material cost for molding containers.

Since a container can be molded with a uniform wall thickness of a body of the container, the wall thickness controlling means is not required. Accordingly, the molding operation for the container is simple.

Portions to be contacted with the adjacent container are specified by the circumferential ribs. Accordingly, the mode of transmission of the pressing force as the conveying force of the containers is constant, whereby the upright attitude of the containers pressed and slidably conveyed is stabilized.

What is claimed is:

1. A biaxially blow-molded bottle-shaped container comprising:

a body with a plurality of longitudinally extending absorbing panel portions uniformly disposed about a circumference of the body and a lower end of the body between the body and a leg of the body, wherein two circumferential ribs are provided and externally swelled on the lower end of the body thereby providing a largest diameter of the container, a diameter of said lower end of the body being smaller than the largest diameter;

upper and lower portions of the circumferential ribs comprise rib walls in a form of a tapered wall; and said two circumferential ribs each have sufficient vertical height such that when pressed against an adjacent container, at least a portion of the vertical height of at least one of the circumferential ribs is the only contact with said adjacent container, even if said adjacent container is slightly inclined and is a similarly shaped article.

2. The container according to claim 1 wherein a circumferential recessed groove having a small width is provided between the circumferential ribs.

3. The container according to claim 1, wherein a diameter of the upper end of the body is equal to that of the lower end of the body;

a circumferential rib is provided and externally swelled on the upper end of the body; and upper and lower portions of the circumferential rib comprise rib walls in the form of a tapered wall.

4. The container according to claim 3, wherein at least two circumferential ribs are provided in parallel on the upper end of the body, and a circumferential recessed groove having a small width is provided between the circumferential ribs.

5. The container according to claim 1, wherein said bottle-shaped container is made of a synthetic resin.

* * * * *